US007762437B2

(12) United States Patent
Holcomb et al.

(10) Patent No.: US 7,762,437 B2
(45) Date of Patent: Jul. 27, 2010

(54) LIQUID CONTAINER AND LID FOR SAME

(75) Inventors: David A. Holcomb, Seattle, WA (US); Jason O. Germany, Seattle, WA (US); Adam A. Jossem, Seattle, WA (US)

(73) Assignee: Chef'n Corporation, Seattle, WA (US)

( * ) Notice: Subject to any disclaimer, the term of this patent is extended or adjusted under 35 U.S.C. 154(b) by 891 days.

(21) Appl. No.: 11/466,749

(22) Filed: Aug. 23, 2006

(65) Prior Publication Data

US 2007/0045313 A1 Mar. 1, 2007

Related U.S. Application Data

(60) Provisional application No. 60/711,797, filed on Aug. 26, 2005, provisional application No. 60/725,935, filed on Oct. 11, 2005.

(51) Int. Cl.
*A47G 19/00* (2006.01)

(52) U.S. Cl. ..... 222/469; 220/714

(58) Field of Classification Search ..... 222/469, 222/470–474; 220/212.5, 714, 715, 203.05, 220/203.07; 215/313
See application file for complete search history.

(56) References Cited

U.S. PATENT DOCUMENTS 1,258,236 A * 3/1918 Menzies ..... 222/536
3,255,930 A * 6/1966 Woodard ..... 222/180
3,410,461 A * 11/1968 Barker ..... 222/516
3,552,608 A * 1/1971 Sperry et al. ..... 222/516
4,519,529 A * 5/1985 Seltz ..... 222/484
4,930,666 A * 6/1990 Rudick ..... 222/484
4,946,079 A * 8/1990 Campbell ..... 222/484
5,797,521 A * 8/1998 Sobral ..... 222/531
6,793,104 B2 * 9/2004 Kao ..... 222/481.5

* cited by examiner

*Primary Examiner*—Lien T Ngo
(74) *Attorney, Agent, or Firm*—Seed IP Law Group PLLC

(57) ABSTRACT

A container for liquids and a lid for the same are shown and described. The disclosed embodiments incorporate a container and a lid, the lid having: a base removably, sealably coupled to the container; a mouth adapted to facilitate drinking and/or pouring liquid out of the container; and a valve member positioned therebetween. The valve member is rotatable between an open orientation in which an aperture in the valve member aligns with openings in the base and mouth, and a closed orientation in which the aperture does not align with one or both of the openings. A handle/actuator can be used to manipulate the valve member, and can be oriented to function as a handle for the container when the valve member is in the closed configuration, and to be moved out of the user's way when the valve member is in the open orientation.

14 Claims, 4 Drawing Sheets

LIQUID CONTAINER AND LID FOR SAME

CROSS-REFERENCE TO RELATED APPLICATIONS

This application claims the benefit under 35 U.S.C. §119 (e) of U.S. Provisional Patent Application No. 60/711,797, filed Aug. 26, 2005; and U.S. Provisional Patent Application No. 60/725,935, filed Oct. 11, 2005, where these two provisional applications are incorporated herein by reference in their entireties.

BACKGROUND OF THE INVENTION

1. Technical Field

The present disclosure is directed toward containers for liquids, and more specifically, to lids for beverage containers.

2. Description of the Related Art

Containers for liquids typically incorporate lids to prevent the liquid from escaping from the container unintentionally. Containers for beverages also often have lids; however, beverage container lids are typically adapted to allow a user to quickly and easily drink from the container, while containers for other liquid typically are not designed for such a purpose.

Perhaps the most common beverage container lid—that is, the ubiquitous, disposable coffee-cup lid—has a small opening that allows the user to drink from the container (and another small aperture allowing air to enter the container), but which prevents the liquid from rapidly spilling. Such lids, however, do allow the liquid to leak from the container when upended.

Beverage lids for traveling or long-term storage, or the like, have lids that seal the liquid in the container, preventing spillage or leakage even when the container is upended. Many of these lids (e.g., what some refer to as the NALGENE® lid) use a threaded cap that completely seals the opening in the container. These lids need to be completely removed from the container for the user to drink from the container.

Other lids completely seal the liquid in the container, but also allow users to quickly drink from the container. Such lids commonly incorporate an opening in the lid and a flap that can be moved against the opening to seal the container or away from the opening to allow the user to drink from the container. Many designs and styles of such containers and lids have been developed and commercialized.

In addition to having resealable openings, travel cups and mugs typically have features that allow the user to carry the container or hook the container to a backpack or the like. A mug-type handle allows the user to carry the drink and drink from the container. Other "handles" have been adapted to facilitate hooking the container to a carabineer or to otherwise hang the container from a belt, backpack or other structure.

BRIEF SUMMARY

The present disclosure is generally directed to containers for liquids and lids for the same. The particular examples shown and described are directed toward beverage containers and, specifically, "travel mugs" and "travel cups." An individual of ordinary skill in the relevant art, having reviewed this entire disclosure, will appreciate the other purposes to which the present invention can be applied.

One embodiment shows and describes a lid for a container for liquid, the lid comprising a body having a first portion and a second portion. The first portion is adapted to be sealingly engaged with the container, and the second portion is adapted to enable an individual to drink therefrom. The first portion has a first opening therethrough oriented to communicate with an interior of the container when the body is engaged therewith, and the second portion has a second opening therethrough. A valve member is captured in the body between the first portion and the second portion. The valve member has an aperture therethrough and is rotatable between an open orientation in which the aperture communicates with both the first opening and the second opening such that liquid can pass through the entire lid, and a closed orientation in which the aperture does not communicate with at least one of the first and second openings such that liquid is prevented from passing through the lid.

Another embodiment shows and describes a beverage holder comprising a container and a lid. The container has an interior adapted to retain a liquid and a mouth through which the liquid may pass, the mouth being oriented about a longitudinal axis. The lid has a body and a valve member, the body having a first portion and a second portion. The first portion of the body is removably, sealingly engaged with the container, and the second portion of the body is adapted to enable liquid to be poured therefrom. The first portion of the body has a first opening therethrough communicating with the interior of the container, and the second portion of the body has a second opening therethrough. The valve member is located between the first and second portions of the body, has an aperture therethrough, and is rotatable between an open orientation in which the aperture communicates with the first and second openings such that liquid can escape the container through the lid, and a closed orientation in which the aperture does not communicate with at least one of the first and second openings such that liquid is prevented from passing through the lid. An actuator can be coupled to the valve member to move as a unit therewith. The actuator can project outward from the lid to be manually manipulable by a user between a first orientation in which the actuator is at least substantially parallel with the longitudinal axis, and a second orientation in which the actuator is angled with respect to the longitudinal axis. The first orientation of the actuator corresponds to the closed orientation of the valve member and the second orientation of the actuator corresponds to the open orientation of the valve member.

DETAILED DESCRIPTION

The present detailed description is generally directed to liquid containers and lids for the same. Many specific details of certain example embodiments are set forth in the following description and in FIGS. 1-6 to provide a thorough understanding of such embodiments. One skilled in the relevant art, however, will understand that the disclosed embodiments may be practiced without one or more of the details described in the following description.

It should be noted that, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Figure 1:
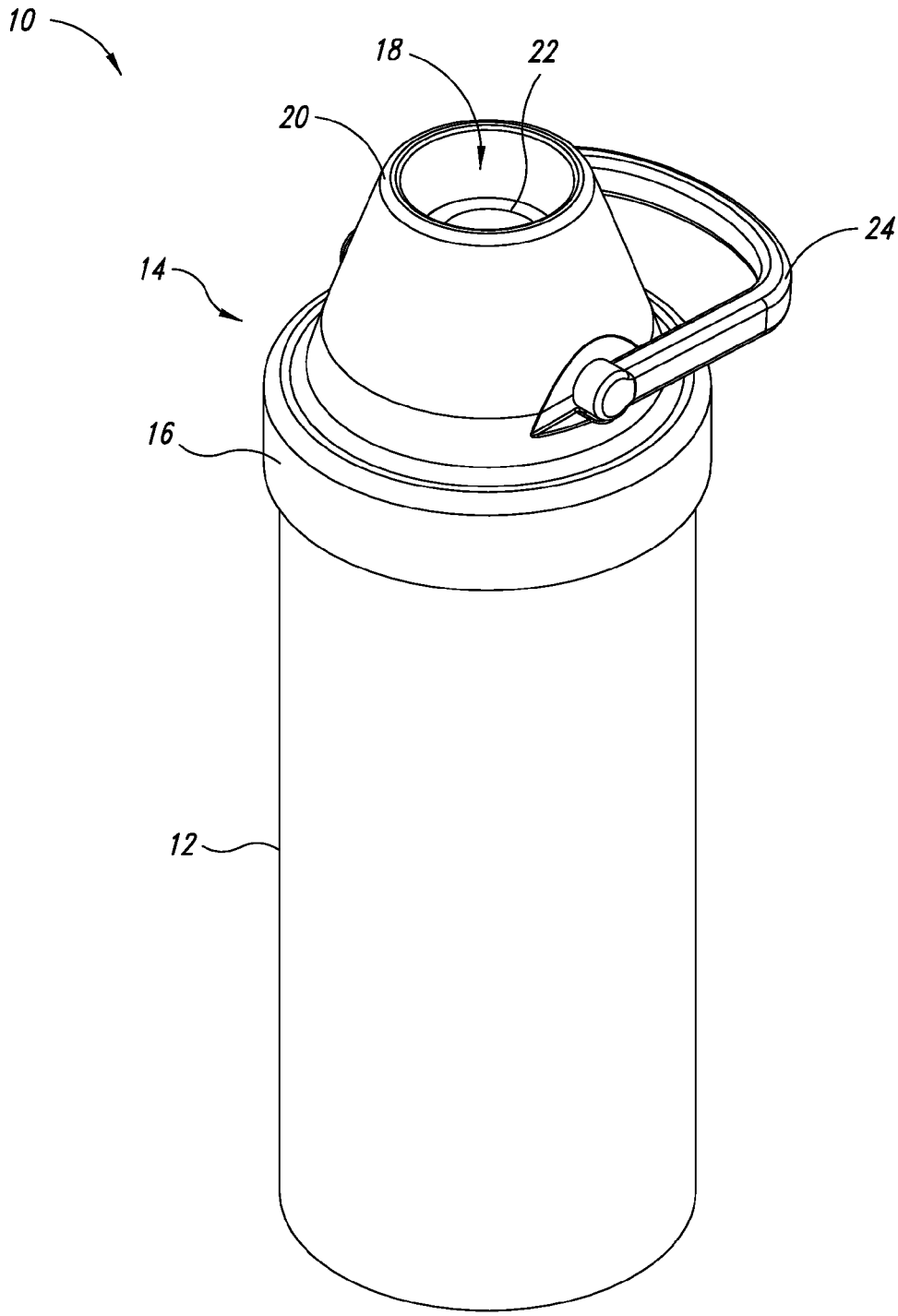
FIG. 1 is an isometric view of a generic liquid container having a lid, according to one embodiment, shown in an open configuration suitable for drinking.
Figure 2:
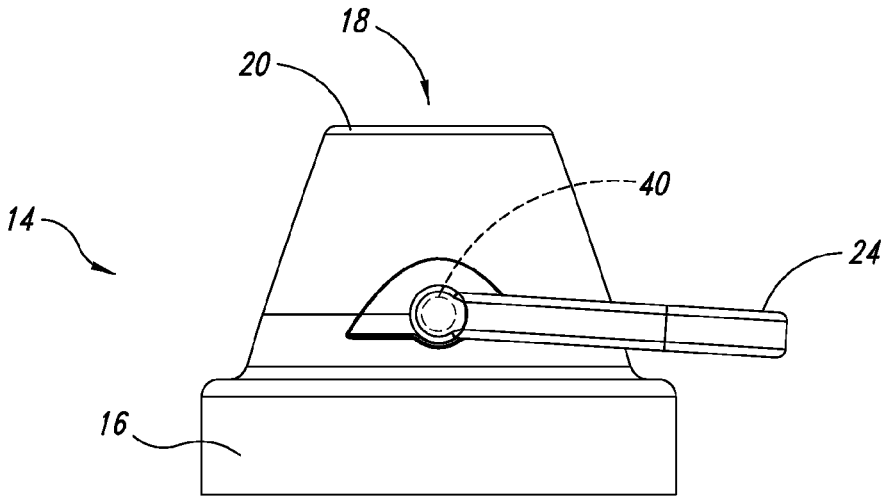
FIG. 2 is an elevation view of the lid of FIG. 1.

FIG. 1 illustrates a container 10 for a beverage or other liquid, having a body 12 and a lid 14. The illustrated body 12 has a generic, cylindrical shape; however, the body can have any suitable shape. Similarly, while the body is likely to be made using glass, ceramic, metal or plastic, it can be made from any suitable material. One of ordinary skill in the relevant art, having review this entire disclosure, will appreciate the options and modifications that can be made to the body without deviating from the spirit of the invention.

The illustrated lid 14 has, generally, a base 16 at its lower end (as viewed in FIG. 1) and a mouth 18 at its opposing, upper end. The mouth 18 is defined by a lip 20, located at the terminal upper end of the lid 14. The base 16 is adapted to be removably, sealably coupled to the body 12 of the container 10, and the mouth 18 and lip 20 are located and adapted to allow a user to comfortably drink liquid from the container via the lid 14. The illustrated base 16 is configured to be screwed onto the body 12. One of ordinary skill in the relevant art, however, having reviewed this entire disclosure, will appreciate that other means can be utilized to couple the lid 14 to the body 12, all of which fall within the scope of the present invention.

The mouth 18 and the lip 20 can be round, or can have a rounded portion; they can have an eccentric portion for added comfort or liquid control; or they can otherwise be adapted to meet any particular needs identified with the class of user to whom the container 10 will be marketed.

Figure 4:
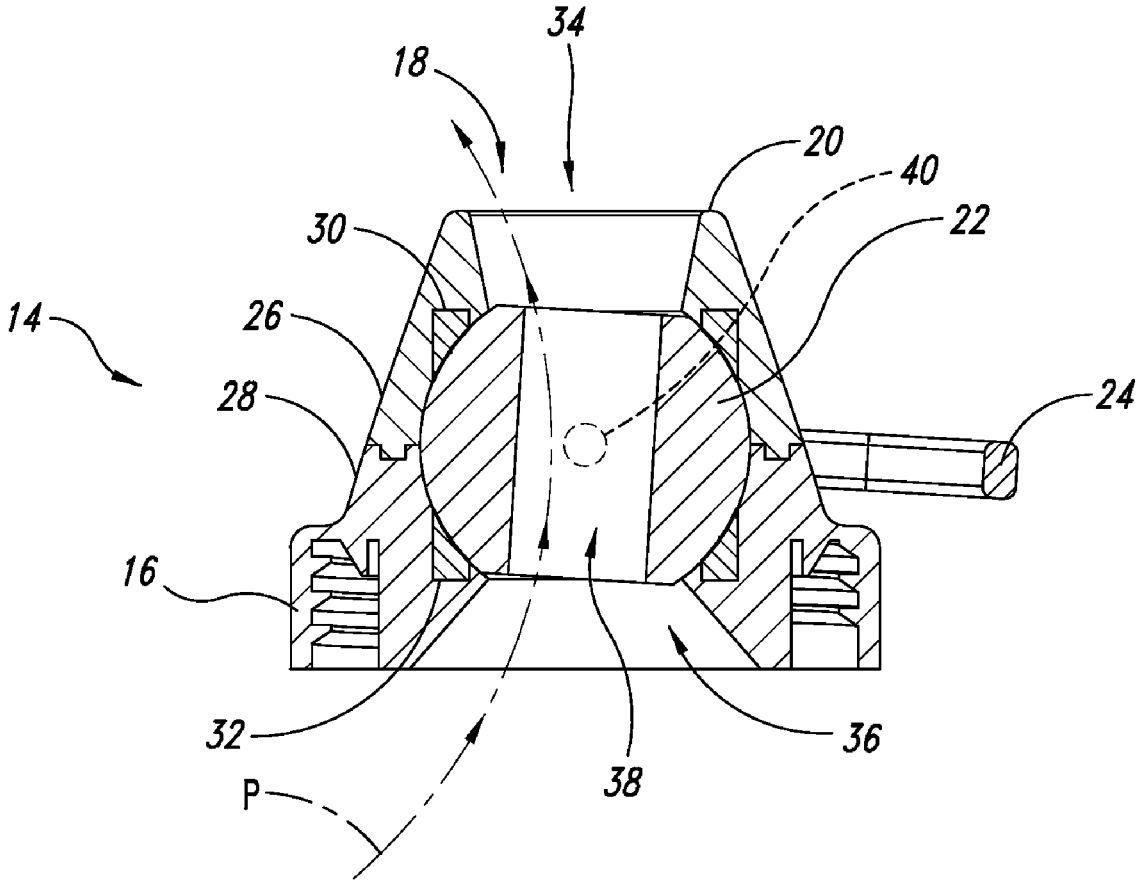
FIG. 4 is a cross-sectional view of the lid of FIG. 1, viewed along Section 4-4 of FIG. 3.
Figure 5:
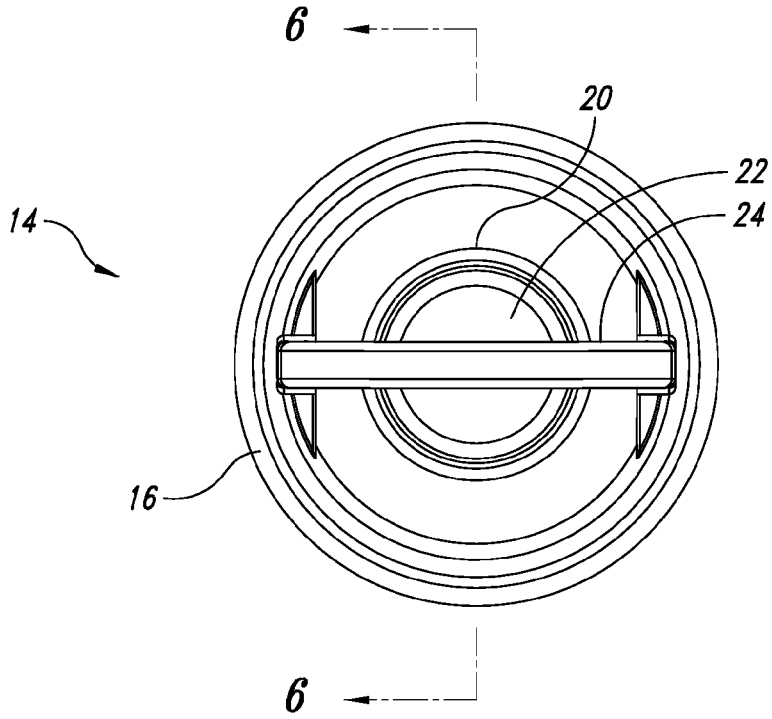
FIG. 5 is a plan view of the lid of FIG. 1, shown in a closed configuration for sealing the liquid in the container.
Figure 6:
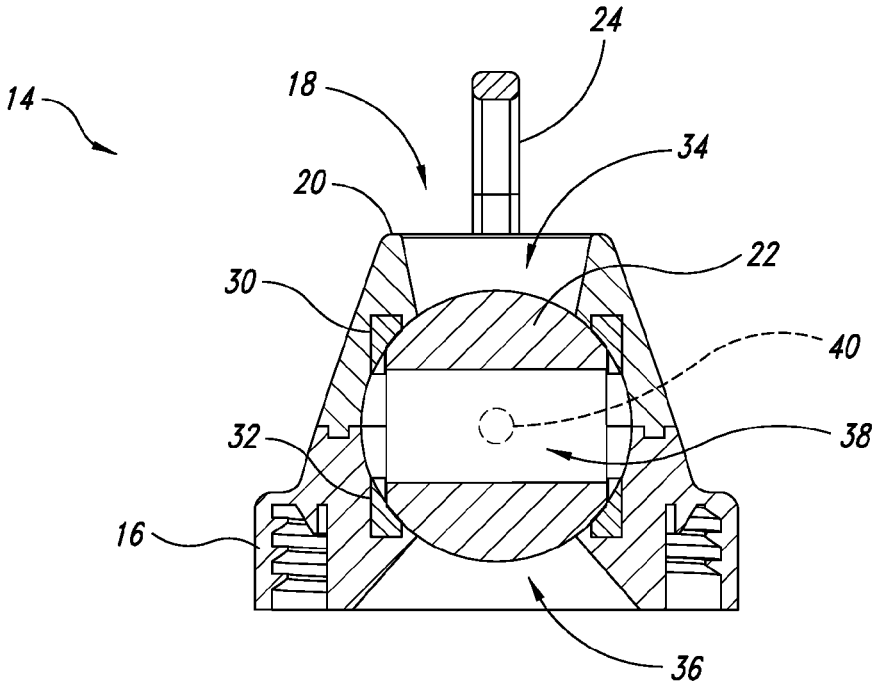
FIG. 6 is a cross-sectional view of the lid of FIG. 5, viewed along Section 6-6.

As best illustrated in FIG. 4, positioned between the base 16 and the mouth 18 of the lid 14 is a valve assembly, comprised of a ball 22 and a handle/actuator 24.

The ball 22 in the illustrated embodiment is sandwiched between an upper section 26 of the lid 14 and a lower section 28 of the lid. The upper section 26 in the illustrated embodiment is attached directly to the lower section 28 to retain the ball 22 therebetween and to provide a convenient means of assembling the lid 14 and valve assembly. One of ordinary skill in the relevant art, having reviewed this entire disclosure, will appreciate that the upper and lower sections 26,28 can be part of a single piece co-molded or otherwise formed over the ball 22 (and any seals, such as those described below).

Figure 3:
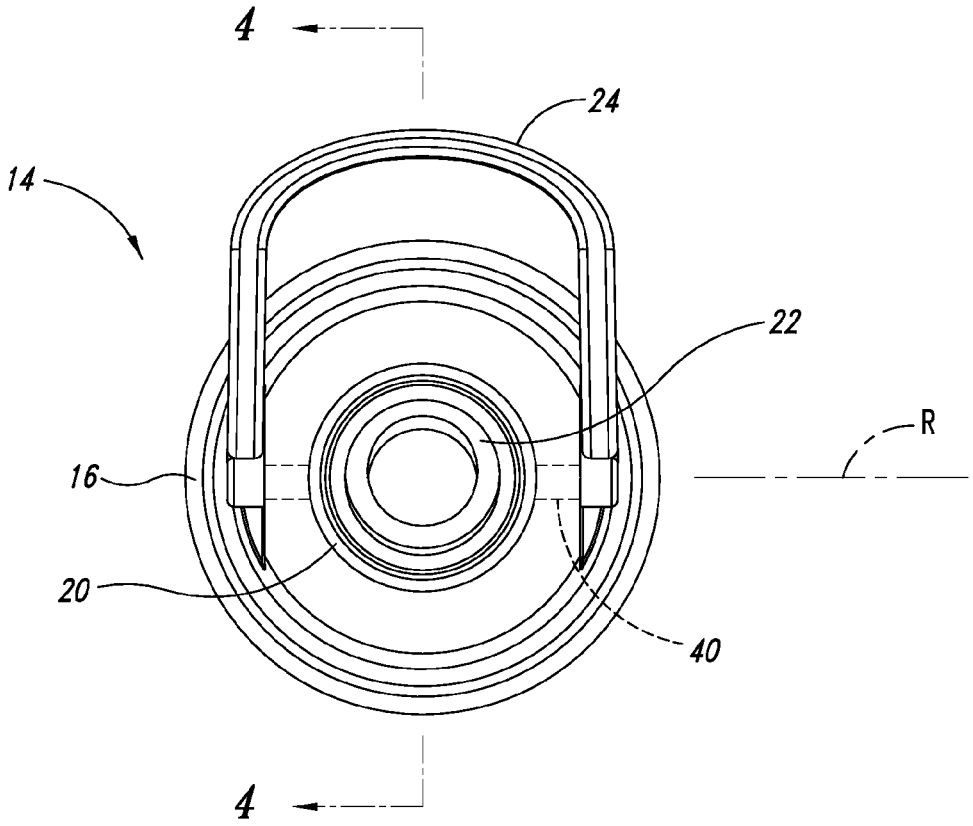
FIG. 3 is a plan view of the lid of FIG. 1.

The upper section 26 incorporates an annular upper seal 30, and the lower section 28 incorporates an annular lower seal 32, each creating a liquid-tight seal between the ball and the respective section of the lid 14 to prevent liquid from passing between the ball and the lid. The seals 30,32 are adapted, however, to allow the ball 22 to be manually rotated with respect to the lid 14 about an axis of rotation "R" (FIG. 3).

The upper section 26 of the lid 14 has an upper opening 36 therethrough, and the lower section 28 of the lid has a lower opening 38 therethrough, aligned with each other to allow liquid to pass along a passageway "P" through the lid when an opening 38 in the ball 22 is in the open orientation (shown in FIG. 4) aligned with the two openings.

The ball 22 is fixedly coupled with respect to the handle/actuator 24 to rotate as a unit therewith within the lid 14, such that a pivoting movement of the handle/actuator results in a rotation of the ball within the lid, both about the axis of rotation R. In the illustrated embodiment, the handle/actuator 24 is fixedly attached to two opposing shafts 40, which are, in turn, rigidly attached to opposing sides of the ball 22. One of ordinary skill in the relevant art, having reviewed this entire disclosure, will appreciate that there are many alternative means for achieving this functionality, all of which are considered by the inventors to fall within the spirit of this invention.

When a user of the container 10 desires to drink therefrom, the user merely urges the handle/actuator 24 to one side of the lid 14 (the illustrated handle/actuator can move both directions), causing the port 38 in the ball 22 to at least partially align with the upper and lower openings 34,36 in the lid. This movement opens the passageway P, allowing the user to drink from the container 10. In opening the passageway P, the user also moves the handle/actuator 24 to one side of the mouth 18, out of its previous position, which would have obstructed the user's access to the mouth of the lid, facilitating drinking. When the user desires to seal the container 10, the user merely moves the handle/actuator 24 to a vertical position (as oriented in FIG. 6), which causes the port 38 in the ball 22 to rotate out of alignment with the passageway P, preventing liquid from passing out of the body 12 of the container. In closing the passageway P, the user also positions the handle/actuator 24 in a convenient location for carrying the container 10; the user can merely grasp the handle/actuator 24 with a finger, carabineer or similar device, and gravity will retain the container in the closed configuration.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, it is not intended that the invention be limited, except as by the appended claims.

What is claimed is:

1. A lid for a container for liquid, the lid comprising:

a body having a first portion and a second portion, an inner end of the first portion adapted to be sealingly engaged with the container, an outer end of the second portion adapted to enable an individual to drink therefrom, the first portion having a first opening therethrough oriented to communicate with an interior of the container when the body is engaged therewith, and the second portion having a second opening therethrough;

a valve member entirely captured in the body between the inner end of the first portion and the outer end of the second portion, the valve member having an aperture therethrough and being rotatable with respect to the first and second portions between an open orientation in which the aperture communicates with both the first opening and the second opening, and a closed orientation in which the aperture does not communicate with at least the second opening; and an actuator coupled to the valve member to move as a unit with the valve member and be manually manipulable to facilitate rotation of the valve member between the open and closed orientations, the actuator extending from the valve member at an angle of about 90 degrees with respect to a longitudinal axis of the aperture such that, when the actuator is parallel to a longitudinal axis of the second opening the valve member is in the closed orientation and the actuator projects above the lid to function as a handle for the container, and when the actuator is angularly displaced by about 90 degrees from the longitudinal axis of the second opening the valve member is in the open orientation and the actuator does not project above the lid to facilitate drinking from the container.

2. The lid of claim 1 wherein the first portion of the lid is part of a first section of the lid and the second portion of the lid is part of a second section of the lid distinct from the first section, and wherein the first section is attached to the second section.

3. The lid of claim 1 wherein the first portion of the lid is part of a first section of the lid and the second portion of the lid is part of a second section of the lid distinct from the first section, the first section being attached to the second section, and the valve member being captured between the first and second sections.

4. The lid of claim 1 wherein the first portion of the lid is part of a first section of the lid and the second portion of the lid is part of a second section of the lid distinct from the first section, the first section being attached to the second section, the valve member being captured between the first and second sections, and further comprising a seal positioned between the first section of the lid and the valve member.

5. The lid of claim 1 wherein the first portion of the lid is part of a first section of the lid and the second portion of the lid is part of a second section of the lid distinct from the first section, the first section being attached to the second section, the valve member being captured between the first and second sections, and further comprising a first seal positioned between the first section of the lid and the valve member and a second seal positioned between the second section of the lid and the valve member.

6. The lid of claim 1 wherein the first portion of the lid is threaded.

7. The lid of claim 1 wherein the first portion of the lid incorporates a female thread.

8. The lid of claim 1 wherein the second portion of the lid terminates in a mouth.

9. The lid of claim 1 wherein the first opening is aligned with the second opening.

10. The lid of claim 1 wherein, in the closed orientation, the aperture in the valve member does not communicate with the first opening or the second opening.

11. A beverage holder comprising:

a container having an interior adapted to retain a liquid and a mouth through which the liquid may pass, the mouth being oriented about a longitudinal axis;

a lid having a body and a valve member, the body having a first portion and a second portion, an inner end of the first portion of the body being removably and sealingly engaged with the container, an outer end of the second portion of the body being adapted to enable liquid to be poured therefrom, the first portion of the body having a first opening therethrough communicating with the interior of the container, the second portion of the body having a second opening therethrough, the valve member being entirely located between the inner end of the first portion and the outer end of second portion, the valve member having an aperture therethrough and being rotatable with respect to the first and second portions between an open orientation in which the aperture communicates with the first and second openings, and a closed orientation in which the aperture does not communicate with at least the second opening; and an actuator coupled to the valve member at a region laterally spaced from a central region of the valve member, and forming a loop, the actuator configured to move as a unit with the valve member and be manually manipulable by a user between a first orientation in which the actuator is at least substantially parallel with the longitudinal axis, and a second orientation in which the actuator is angled with respect to the longitudinal axis, the first orientation of the actuator corresponding to the closed orientation of the valve member and the second orientation of the actuator corresponding to the open orientation of the valve member.

12. The beverage holder of claim 11 wherein the actuator can be moved from the first orientation to the second orientation in either of two directions.

13. The beverage holder of claim 11 wherein the actuator has an opening therein adapted to facilitate the user carrying the beverage holder, the actuator being urged into the first orientation, and the valve member into the closed orientation, under the force of gravity when the user carries the beverage holder by the actuator.

14. A lid for a container for liquid, the lid comprising:

a body having a first portion and a second portion, an inner end of the first portion adapted to be sealingly engaged with the container, an outer end of the second portion adapted to enable an individual to drink therefrom, the first portion having a first opening therethrough oriented to communicate with an interior of the container when the body is engaged therewith, and the second portion having a second opening therethrough;

a valve member entirely captured in the body between the inner end of the first portion and the outer end of the second portion, the valve member having an aperture therethrough and being rotatable with respect to the first and second portions between an open orientation in which the aperture communicates with both the first opening and the second opening, and a closed orientation in which the aperture does not communicate with at least the second opening; and an actuator coupled to a region of the valve member laterally spaced from a central region of the valve member, the actuator being manipulable to facilitate rotation of the valve member between the open and closed orientations, the actuator forming an opening adapted to facilitate carrying the liquid container, the actuator being urged into the first orientation, and the valve member into the closed orientation, under the force of gravity when the liquid container is carried by the actuator.

* * * * *